United States Patent [19]

Agnew et al.

[11] 4,000,951

[45] Jan. 4, 1977

[54] LOOSE LEAF BINDERS

[76] Inventors: Kenneth Malcolm Agnew, 10 Chesterfield Road, London W4; Charles Henry Pentland Denroche, 90 Park Road, Hampton Wick, Kingston-upon-Thames, Surrey; Roy Hewlett, 46 Lytton Grove, London SW15, all of England

[22] Filed: May 6, 1974

[21] Appl. No.: 467,363

[30] Foreign Application Priority Data

May 8, 1973 United Kingdom ..... 21950/73

[52] U.S. Cl. ..... 402/22; 402/45; 402/63; 402/68; 402/71; 402/75

[51] Int. Cl.[2] ..... B42F 3/00; B42F 13/02

[58] Field of Search ..... 402/8, 14, 15, 19, 21, 402/22, 23, 26, 29, 42, 45, 47, 60, 61, 63, 68, 70, 71, 73, 74, 75, 80 R; 24/16 PB; 16/DIG. 13; 281/17

[56] References Cited

UNITED STATES PATENTS

| | | | |
|---|---|---|---|
| 988,090 | 3/1911 | Hamilton | 402/14 |
| 2,133,069 | 10/1938 | Williamson | 402/15 |
| 3,087,498 | 4/1963 | Vogel | 402/22 |
| 3,383,786 | 5/1968 | McIntosh | 402/8 |
| 3,536,202 | 11/1970 | Vernon | 220/339 X |
| 3,537,146 | 11/1970 | Caveney | 24/16 PB |
| 3,768,838 | 10/1973 | Shibata | 281/17 |
| 3,854,650 | 12/1974 | Hanaue | 16/DIG. 13 |

FOREIGN PATENTS OR APPLICATIONS

| | | | |
|---|---|---|---|
| 1,263,690 | 3/1968 | Germany | 402/22 |
| 1,142,152 | 1/1963 | Germany | 402/70 |
| 656,635 | 10/1963 | Italy | 402/8 |
| 637,897 | 5/1950 | United Kingdom | 402/14 |

*Primary Examiner*—Jerome Schnall
*Attorney, Agent, or Firm*—Woodhams, Blanchard and Flynn

[57] ABSTRACT

A loose leaf binder which can be moulded as an integral structure from resilient plastics, e.g. polypropylene has posts which lie in openings in a side portion of the binder and are pivotable into the upright position. Projections on the posts or the side portion adjacent the pivotal connection serve to maintain the posts releasably in the upright position. The free ends of the posts are engageable in openings in the other side portion and movable locking members are provided to positively lock the ends of the posts in these openings.

5 Claims, 5 Drawing Figures

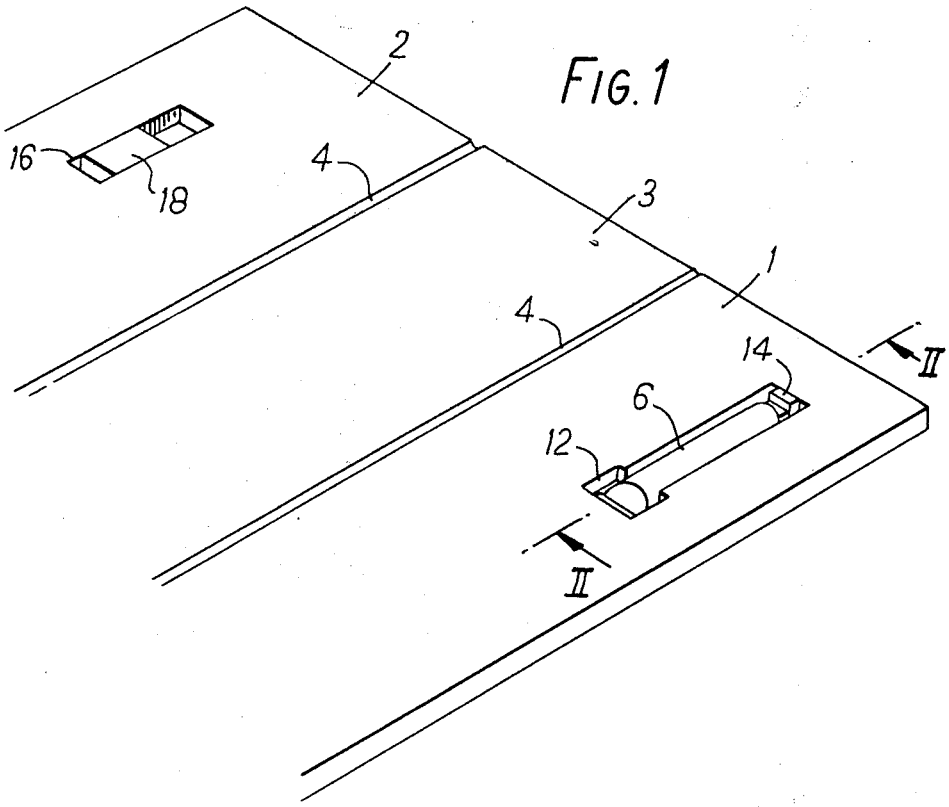
FIG. 1
FIG. 4
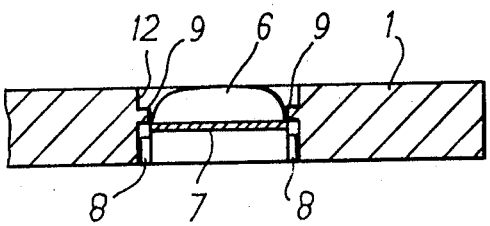

LOOSE LEAF BINDERS

The present invention relates to improvements in loose leaf binders.

Generally, the invention relates to a loose leaf binder having two side portions for placing on either side of a sheaf of papers or other material to be bound, one of the side portions having a post for passing through a hole in the papers and coupling releasably with the other side portion.

In an advantageous embodiment of the invention, the binder is formed as an integral structure of moulded resiliently deformable plastics material. The post of the binder is arranged to be pivotable. This has the advantage that the binder can be injection-moulded in a flat condition, with the post positioned in the plane of one of the side portions. Preferably, the other side portion has means for coupling releasably with the free end of the post. In the most convenient forms of the binder, the post will be laterally immovable relative to the said one side portion.

The said other side portion may have a movable locking member adapted to positively lock the free end of the post releasably in engagement therewith.

In the preferred form, the positive locking is provided by the post having at its free end a shoulder which can engage with a side surface of an opening in the other side portion, and the movable member is adapted to releasably hold the shoulder in engagement with the surface. In the locking position, the movable member may be adjacent the side of the post opposite to the side having the shoulder thereon.

A number of posts may be provided on a single side portion, the posts conveniently being spaced apart at conventional punch-hole spacings.

In order to maintain the posts in the upright position after they have been pivoted out of the plane of the side portion, the posts and/or the side portion may be provided with one or more projections near their points of pivotal connection, the projections engaging with cooperating surfaces when the posts are pivoted upwardly.

A loose leaf binder in accordance with the invention will now be described, by way of example only, with reference to the accompanying drawings in which:

FIG. 1 shows in perspective a loose leaf binder according to the invention;

FIG. 4 shows the binder in section along the lines IV—IV of FIG. 3; and

Figure 2:
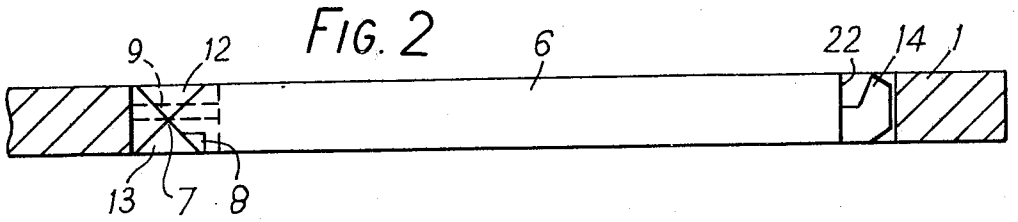
FIG. 2 shows the binder in section along the line II—II in FIG. 1.
Figure 3:
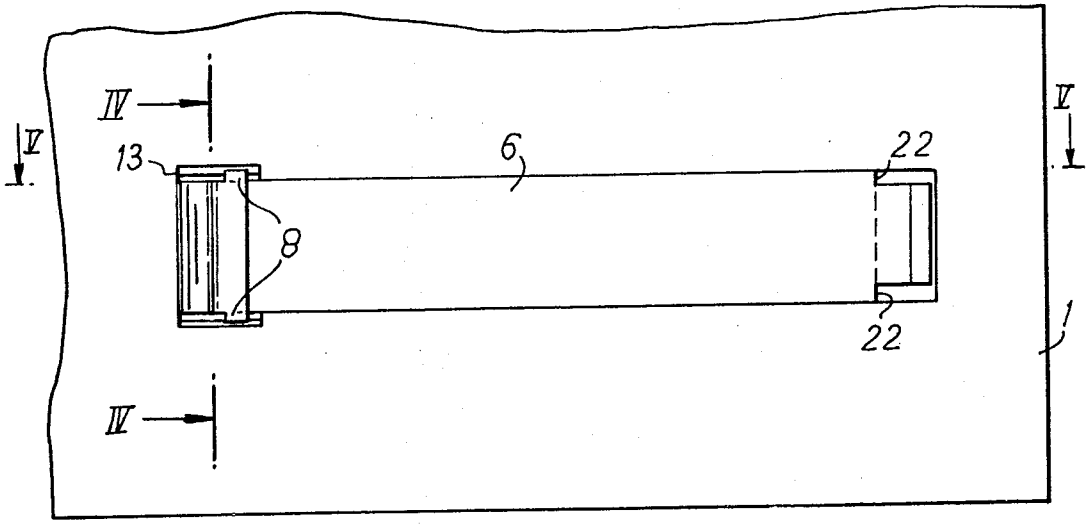
FIG. 3 shows a view from the underside of the binder of FIG. 1.

Referring to the drawings, the binder comprises two side portions 1 and 2, respectively, hinged on opposite edges of a back portion 3. Grooves 4 are formed on the inner face of the binder between each side portion 1 and 2 and the back portion 3. The grooves 4 constitute hinge lines about which the side portions 1 and 2 can be pivoted upwardly towards one another to close the binder and provide a channel for receiving the edges of the papers to be bound.

A post 6, for passing through punch-holes in the papers to be bound, is formed integrally with the said one side portion 1. The post 6 is pivotally connected to the side portion 1 by a narrow neck portion 7 so that in use the post 6 can be pivoted from a manufacturing and storage position shown in FIGS. 1 to 4, in which the post 6 lies in the plane of the side portion 1, to an upright position shown in FIG. 5.

In order to maintain the post 6 in its upright position, triangular-section projections 8 are provided on the side of the post 6 near the neck portion 7 and adjacent the outer face of the side portion 1. When the post is pivoted into its upright position, the projections 8 rise above the post's pivotal connection constituted by the neck portion 7 and surfaces thereof facing toward the neck portion 7 engage on the upper surfaces of the ribs 9 which project inwardly from the opposite sides of a slot 11 in which the post is received in the said one side portion 1, and hence return movement of the post 6 to the storage position shown in FIGS. 1 to 4 is resisted.

The opposite faces of the said one side portion 1 each have a recess in the region of the neck portion 7, the two recesses being indicated at 12 and 13, respectively in the drawings, and these recesses accommodate the projections 8 when the post is in the upright and storage positions, respectively.

In order to facilitate movement of the projections 8 past the ribs 9 when erecting the post 6, the projections 8 and the ribs 9 are of resiliently deformable material, e.g. resilient plastics.

Figure 5:
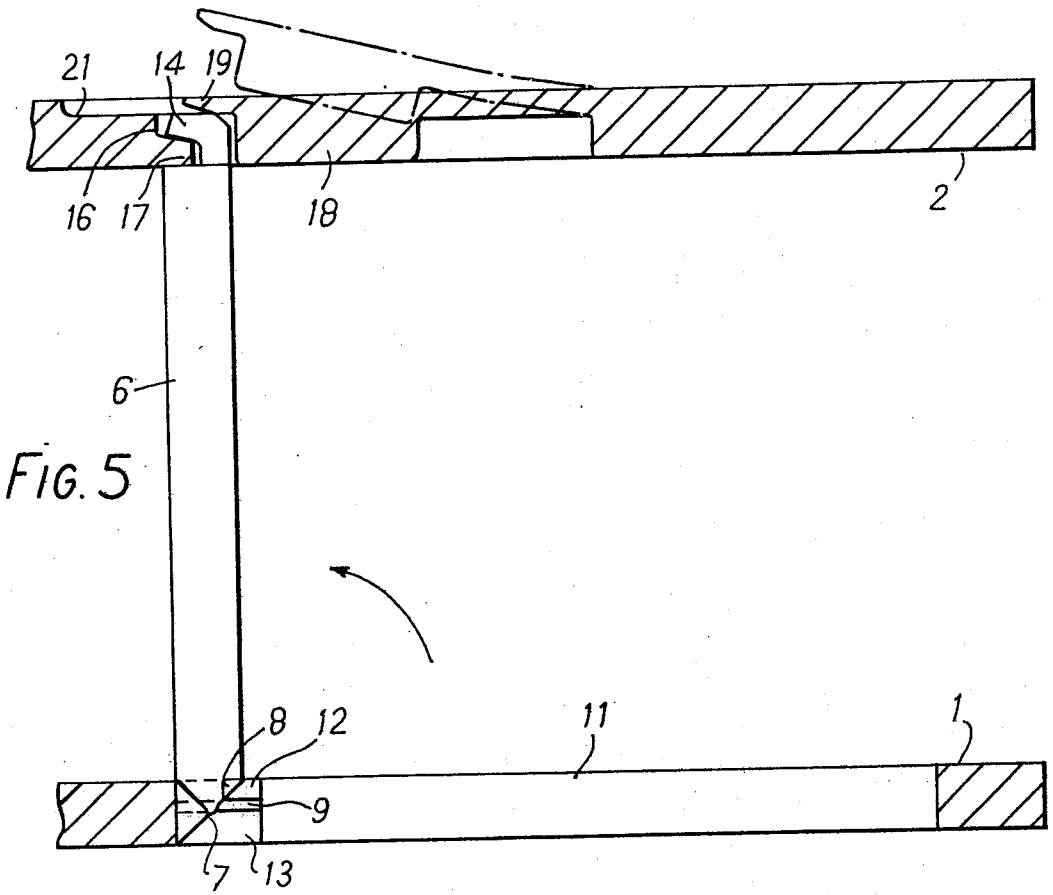
FIG. 5 shows the binder with the post in the upright position coupled with the other side portion, the view being along the section line V—V of FIG. 3.

After placing loose leaves in the binder, with the post 6 passing through punch holes in the leaves, the free end of the post 6 can be releasably locked in engagement with the other side portion 2, as shown in FIG. 5.

For this purpose, the free end of the post 6 is hooked shaped and provides a transverse projection 14 which can be inserted in a slot 16 in the side portion 2, with the shoulder formed by the under surface of the projection 14 engaging the upper surface of a member 17 which extends from an edge of the slot 16. The locking is effected by a pivotally movable portion 18 on the side portion 2 opposite the edge of the slot 16 having the member 17 thereon. In the locking position shown in solid lines in FIG. 5 the portion 18 resists lateral movement of the projection 14 away from the rim 17 of the slot 16. When locking or unlocking the post 6, the user can pivot the movable portion 18 away from the locking position to the position shown in broken lines in FIG. 5 to allow the free end of the post 6 to be introduced into or disengaged from the slot 16. The movable portion 18 is provided with a tab 19, and a recess 21 is formed in outer face of the side portion 2 so that the movable portion 18 can be lifted with the finger.

In the form shown in the drawings, the free end of the post 6 is stepped to provide longitudinal and transverse shoulders 22 at the base of the hook-shaped portion which can engage with the inner face of the side portion 2. The sides of the hook-shaped portion and of the projection 14 may be tapered to facilitate introducing the post 6 into the slot 16.

As shown in the drawings the slot 16 is stepped so that the rim 17 on which the projection 14 engages is offset towards the inner face of the side portion 2. This avoids the post 6 protruding above the outer face of the side portion 2 and gives a neat appearance to the binder when in the closed position.

In the most useful forms of the binder, the side portions 1 and 2 will be provided with a number of sets of posts and locking arrangements, the number of posts and their arrangements being the same as one of the standard punch-hole arrangements for loose leaves.

In the preferred form, the binder described above is moulded is plastics as a unitary structure, e.g. by injection moulding.

It is preferred to employ polypropylene. Other suitable resiliently deformable plastics materials include high-density polyethylene, nylon, reinforced nylon and polyterephthalate.

In the preferred form, the structure shown in the drawings, is moulded in the configuration shown in FIG. 1, that is to say as a substantially flat structure with the posts lying in the plane of the structure. This flat structure is convenient for storage or transport since a number of the binders can be packed flat together and occupy minimum volume.

We claim:

1. A loose-leaf binder formed in one piece of resiliently deformable plastics material and comprising in integral form a back portion and first and second side portions hinged on opposite edges of said back portion, said first side portion having an elongate opening therein extending generally parallel to said edges, a rigid post lying in said opening and connected by a hinge portion to one end of said opening, said post having a first reaction surface thereon spaced from said hinge portion, said first side portion having a projection extending from a side of said opening, said projection providing a second reaction surface spaced from said hinged portion by approximately the same distance as said first reaction surface, whereby when said post is pivoted upwardly from said opening said reaction surfaces cooperate to retain said post in an upright position, said second side portion having a second opening in a face thereof, means at the edge of said second opening providing an abutment surface facing away from said face, the end of said post remote from said hinge portion having a shoulder formed thereon, said end of said post being insertable in said second opening with said shoulder contacting said abutment surface, and a locking member on said second side portion and movable into and out of said second opening respectively to retain said shoulder in contact with said abutment surface and to release said shoulder therefrom.

2. A binder as claimed in claim 1, wherein the other end of said post is free of connection to said first side portion and has a hook-shaped configuration.

3. A binder as claimed in claim 2, wherein said means at the edge of said second opening comprises a recess formed in the face of said second side portion which is disposed remote from said first side portion, said recess communicating with said second opening and having the bottom thereof defined by a shoulder which engages with the hook-shaped end of said post.

4. A binder as claimed in claim 3, wherein said locking member is integrally and hingedly connected to said second side portion, said locking member including a portion which overlaps the hook-shaped end of said post when same is engaged with said shoulder for maintaining said hook-shaped end in engagement with said second side portion, said locking member having the outer surface thereof substantially flush with the face of said second side portion.

5. A binder as claimed in claim 1, wherein said locking member is pivotally connected to said second side portion at an edge of said second opening.

* * * * *